US006060823A

United States Patent [19]

Okamoto et al.

[11] Patent Number: 6,060,823

[45] Date of Patent: May 9, 2000

[54] FIELD EMISSION COLD CATHODE ELEMENT

[75] Inventors: Akihiko Okamoto; Hisashi Takemura; Yoshinori Tomihari; Naruaki Takada, all of Tokyo, Japan

[73] Assignee: NEC Corporation, Tokyo, Japan

[21] Appl. No.: 09/046,700

[22] Filed: Mar. 24, 1998

[30] Foreign Application Priority Data

Mar. 27, 1997 [JP] Japan ..... 9-075455

[51] Int. Cl.[7] ..... H01J 1/02

[52] U.S. Cl. ..... 313/309; 313/336; 313/351; 313/495

[58] Field of Search ..... 313/309, 310, 313/336, 351, 495

[56] References Cited

U.S. PATENT DOCUMENTS 5,731,228 3/1998 Endo et al. ..... 313/309

FOREIGN PATENT DOCUMENTS 4-249026 9/1992 Japan .
5-94760 4/1993 Japan .
7-130281 5/1995 Japan .

*Primary Examiner*—Vip Patel
*Attorney, Agent, or Firm*—McGinn & Gibb, P.C.

[57] ABSTRACT

A field emission cold cathode element designed with the objects of enabling control of overcurrents that arise at times of discharge without adding a power source or complicating the operating circuits, realizing high-frequency operation and lower power consumption without giving rise to short-circuit damage due to discharge breakdown, and moreover, suppressing increases in element temperature; wherein an n-type region underlying emitters is divided between three n-type semiconductor regions: a first n-type semiconductor region, a second n-type semiconductor region and a third n-type semiconductor region. A third n-type semiconductor region below the emitters formed so as to be surrounded by a p-type semiconductor region, a second n-type semiconductor region below the third n-type semiconductor region formed so as to be surrounded by a p-type semiconductor region, and a first n-type semiconductor region formed below the second n-type semiconductor region; wherein the cross section of the second n-type semiconductor region is smaller than the cross section of the third n-type semiconductor region, thereby producing an n-type region made up of three n-type semiconductor regions that has a constricted shape.

12 Claims, 5 Drawing Sheets

FIELD EMISSION COLD CATHODE ELEMENT

BACKGROUND OF THE INVENTION

1. Field of the Invention

The present invention relates to a field emission cold cathode element, and particularly to a field emission cold cathode element having a current control element connected to an emitter.

2. Description of the Related Art

A field emission cold cathode element is an element including sharp, cone-shaped emitters and submicron openings, and that focuses a high electric field at the emitter tips by means of a gate electrode formed in proximity to the emitters, thereby emitting electrons from the emitter tips into a vacuum. This type of field emission cold cathode element has the problem that discharges may occur during operation between the emitters and the gate or anode electrode due to, for example, the effect of gas, and as a result of such discharges, a large current flows to emitters, the emitter material fuses, and short circuits occur between the emitters and gate.

In addition, the adhesion of minute extraneous particles to the element may cause short circuits between the gate and emitters and a rise in emitter potential. As a countermeasure, elements have been developed in which resistors are added in series to the emitters to control the current of discharges and thereby prevent fusing of the emitters. Such methods, however, entail the drawback of increases in operation voltage due to drops in potential in the resistance layer even during normal operation when discharges do not occur.

A method of forming an active element at the emitters having a saturation current characteristic has also been proposed as a method of controlling current flowing to emitters.

This type of field emission cold cathode element is explained hereinbelow with reference to the accompanying figures.

As shown in FIG. 1, the first example of the prior art is made up of sharp, cone-shaped emitter 106 composed of, for example, molybdenum; gate electrode 107 composed of tungsten formed so as to surround emitter 106, insulation film 108 composed of an oxide film formed below gate electrode 107, n-type silicon 103 connected to emitter 106; p-type silicon 105 formed so as to surround n-type silicon 103; p-type lead electrode 113 composed of tungsten and connected to p-type silicon 105; n-type silicon substrate 101 connected to n-type silicon 103 and p-type silicon 105; and substrate electrode 109 connected to n-type silicon substrate 101.

In a field emission cold cathode element constructed according to the foregoing description, a junction-type field effect transistor is formed from n-type silicon 103, p-type silicon 105, and n-type silicon substrate 101; and current flowing within n-type silicon 103 can be controlled by varying voltage impressed to p-type silicon 105. In addition, to ensure dielectric strength, the concentration of n-type impurity in n-type silicon 103 is set to substantially the same level as the concentration of p-type impurity in p-type silicon 105, and the depth of n-type silicon 103 is set to exceed a value obtained by dividing twice the voltage impressed between emitter 106 and n-type silicon substrate 101 by the breakdown field intensity.

In the second example of the prior art, as shown in FIG. 2, a bipolar transistor is formed from n-type silicon 203 formed below emitter 206 and p-type silicon 214 formed below n-type silicon 203. The current flowing from n-type silicon 203, which constitutes the emitter of the bipolar transistor, to n-type silicon substrate 201, which constitutes the collector of the bipolar transistor, can be controlled by varying the voltage impressed to p-type silicon 214, which constitutes the base of the bipolar transistor.

Nevertheless, above-described field emission cold cathode elements of the prior art have the following drawbacks:

(1) In addition to the components that are required in an ordinary field emission cold cathode element, i.e., the cathode electrode, gate electrode, anode electrode that receives emitted electrons, and independent power sources connected to these components, the above-described elements further necessitate an electrode for current control and a power source that supplies power to this electrode.

For example, the device shown in FIG. 1 requires p-type lead electrode 113 for controlling the voltage impressed to p-type silicon 105.

Furthermore, the employment of an active element in the device shown in FIG. 2 necessitates the provision of many peripheral circuits for controlling the base current or voltage, and also necessitates an electrode and power source in addition to the cathode electrode, gate electrode, anode electrode for receiving electrons, and independent power sources connected to these components that are required in an ordinary field emission cold cathode element. In particular, a potential that is a forward voltage compared with the potential at n-type silicon substrate 201 must be impressed to p-type silicon 214, and as a result, the power source cannot be made common with the other power source.

As a result, in a case in which the current is controlled by means of an active element of the prior art, the element increases in size and the number of circuits provided peripheral to the device increase in number, thereby complicating the composition of the device.

(2) As shown in FIG. 1, when current flows in the direction of depth from emitter 106 toward substrate electrode 109, the depth of n-type silicon 103 in which current is controlled by p-type silicon 105 must be formed with a uniform width of 10 $\mu$m or more in order to ensure dielectric strength.

As a result, electrons travel through a silicon layer having a depth of 10 $\mu$m or more during ordinary operation, and this gives rise to resistance of the silicon layer portion and an increase in the resistance of the rise current of the current-voltage characteristic of the transistor, thereby impeding high-speed operation of the element overall, increasing power consumption, and moreover, increasing temperature of the element when operating at high currents.

(3) If the n-type silicon is formed by a diffusion method, the width of the layer broadens with increasing depth, and this complicates formation of a layer of uniform width. The layer is therefore formed by methods such as ion implantation, but ion implantation must be carried out a number of times because the depth of spreading varies across the transverse direction of the layer.

In addition, such processes as thickening the film of the implantation mask are also complex.

SUMMARY OF THE INVENTION

The object of the present invention is to provide a field emission cold cathode element that can limit overcurrents produced during discharges without adding an additional power source or complicating the operation circuits, that can provide for high-frequency operation and low power consumption without giving rise to short-circuit damage due to discharge breakdown, and moreover, that can suppress temperature increases of the element.

In the present invention, the portion below the emitters is divided between three n-type semiconductor regions: a first n-type semiconductor region, a second n-type semiconductor region and a third n-type semiconductor region. A third n-type semiconductor region formed so as to be surrounded by a second p-type semiconductor region; a second n-type semiconductor region formed below the third n-type semiconductor region so as to be surrounded by a first p-type semiconductor region; and finally, a first n-type semiconductor region formed below this second n-type semiconductor region. The cross section of the second n-type semiconductor region is smaller than the cross section of the third n-type semiconductor region, and the n-type regions comprising three n-type semiconductor regions thereby takes on a shape having a constricted midsection. Electrons emitted by the emitters are supplied from the first n-type semiconductor region, pass through the constricted second n-type semiconductor region, spread out in the third n-type semiconductor region, reach the emitters, and then are finally emitted.

In addition, in the event of an electrical short-circuit between the first n-type semiconductor region and the first or second p-type semiconductor region, the potential of the second n-type semiconductor region also rises when the potential of the third n-type semiconductor region in the vicinity of the emitters rises, and a potential gradient occurs between the first n-type semiconductor region and the second n-type semiconductor region. In this case, portions in the second n-type semiconductor region that are at a distance from the first p-type semiconductor region have a high potential while portions that are near have a low potential.

In other words, a depletion layer spreads from the first p-type semiconductor region.

When the potentials of the third n-type semiconductor region and the second p-type semiconductor region are raised, the depletion layer of the second n-type semiconductor region spreads, the depletion layer ultimately spreading across the entire n-type region and entering a pinch-off state. Accordingly, after a pinch-off state is entered, increasing the potentials of the third n-type semiconductor region and the second p-type semiconductor region results in almost no increase in the flowing current, and the amount of increase is extremely small until breakdown.

In the event of discharge between emitter and gate, the emitter potential is therefore the same as the gate potential $V_g$ even at maximum.

In experiments, the element breakdown current must be suppressed to 10 mA or less, but the discharge breakdown can be suppressed if the current after entering the pinch-off state is suppressed to the maximum breakdown current or less.

At this time, the average thickness w in the direction of depth of the third n-type semiconductor region should be set such that:

$$w > 2\ V_g/\epsilon \tag{1}$$

where the breakdown field intensity is $\epsilon$, but if the carrier concentration is low, $\epsilon$ increases and w can be set at a lower level.

On the other hand, the resistance in this construction during normal operation is determined by the resistance when electrons are flowing through the first to third n-type semiconductor regions, and the resistance $r_1$ of the third n-type semiconductor region is:

$$r_1 = \rho_1 w_1 / s_1$$

Here, $\rho_1$ is the specific resistance of the third n-type semiconductor region, and $s_1$ is the average cross section of the third n-type semiconductor region cut parallel to the substrate surface.

If the carrier concentration per unit of volume is $n_1$, the electron charge is e, and the electron speed is $v_1$:

$$\rho = 1/n_1 e\ v_1$$

Accordingly:

$$r_1 = w_1 / n_1 e\ v_1 s_1 \tag{2}$$

Achieving dielectric strength imposes limits on $w_1$ and $n_1$ as indicated by equation (1), but $s_1$ can be increased regardless of the cross section of the second n-type semiconductor region, and a lower resistance can therefore be designed for times of normal operation without discharges. Similarly, resistance $r_2$ of the second n-type semiconductor region is:

$$r_2 = w_2 / n_2 e\ v_2 s_2 \tag{3}$$

Here, $\rho_2$ is the specific resistance of the second n-type semiconductor region, $n_2$ is the carrier concentration per units of volume, $v_2$ is the speed of the electrons, and $s_2$ is the average cross section of the second n-type semiconductor region cut parallel with the substrate surface.

The saturation current Is increases with increase in $s_2$ and increases with decreases in $w_2$, but when $w_2$ is decreased or $s_2$ is increased in order to decrease resistance $r_2$, $I_s$ increases and breakdown voltage decreases, and the technical merit of element breakdown prevention is lost.

These values must therefore be set at optimum values. The first and second p-type semiconductor regions have electrodes led out which are fixed to a constant-current source, and the need for extra circuit devices such as power sources can be eliminated by fixing to the same potential as the substrate potential.

In addition, formation of an $n^+$-type semiconductor region below the emitters not only allows formation of excellent ohmic contact between emitters and the n-type region, but also prevents breakdowns due to the occurrence of the punch-through phenomenon caused by spread of the depletion layer in a transverse direction from the second p-type semiconductor region.

The above and other objects, features, and advantages of the present invention will become apparent from the following description referring to the accompanying drawings which illustrate an example of a preferred embodiment of the present invention.

DETAILED DESCRIPTION OF THE PREFERRED EMBODIMENTS

Figure 1:
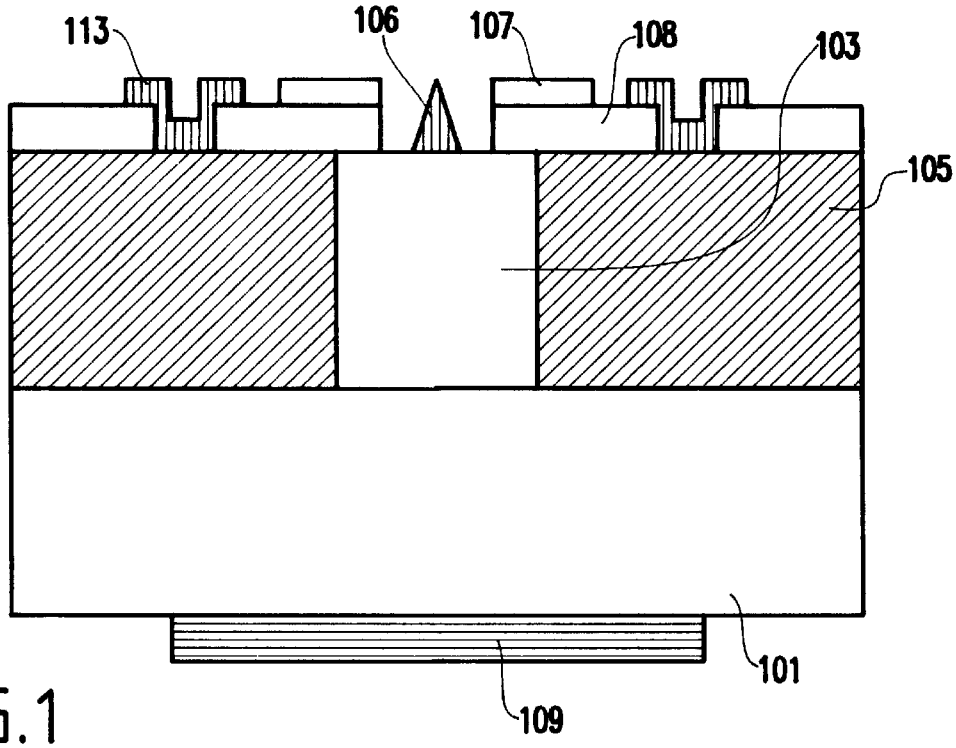
FIG.1 PRIOR ART
FIG. 1 is a sectional view showing the construction of a first example of a field emission cold cathode of the prior art.
Figure 2:
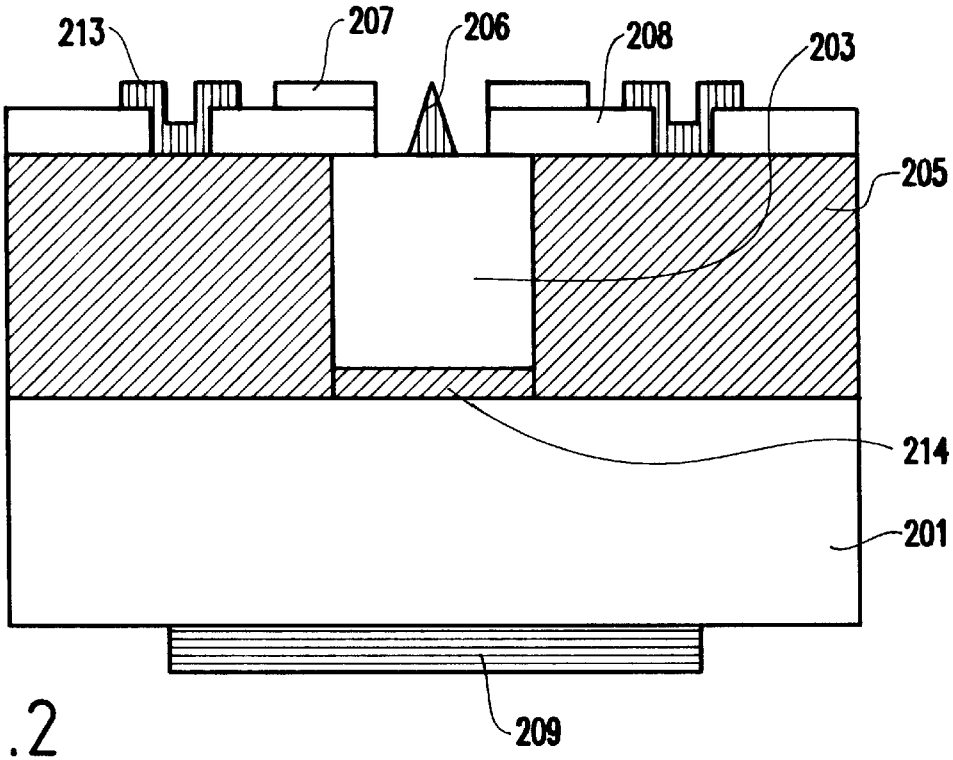
FIG.2 PRIOR ART
FIG. 2 is a sectional view showing the construction of a second example of a field emission cold cathode of the prior art.
Figure 3A:
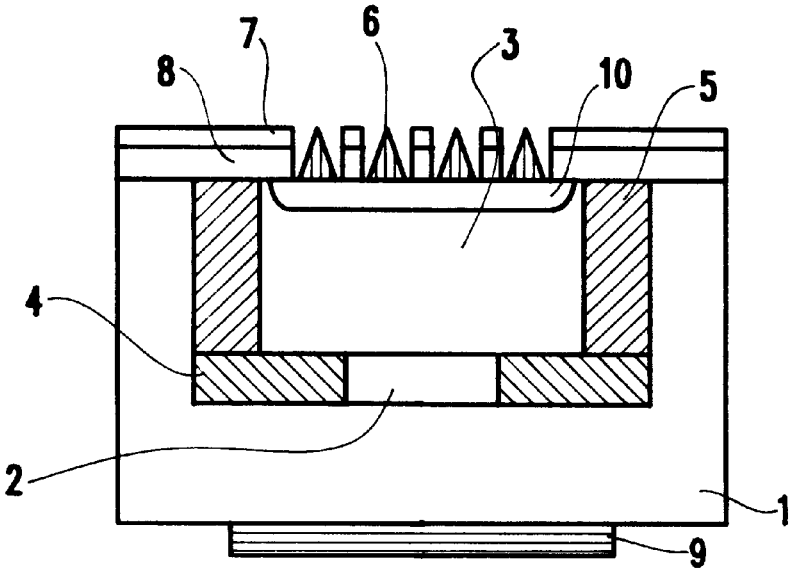
FIG. 3*a* is a sectional view of the first embodiment of the field emission cold cathode element of the present invention.
Figure 3B:
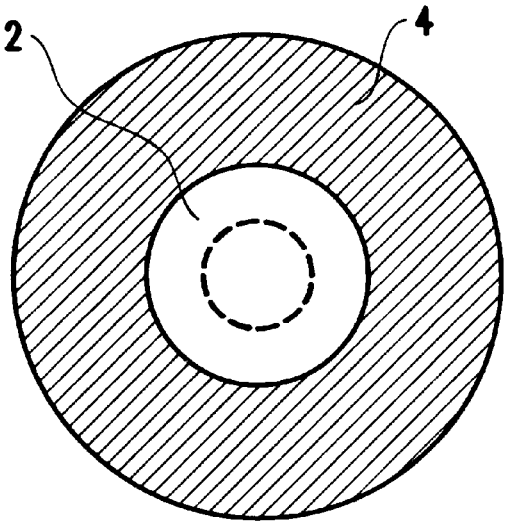
FIG. 3*b* is an upper plan view of the n-type semiconductor region and the p-type semiconductor region shown in FIG. 3*a*.
Figure 3C:
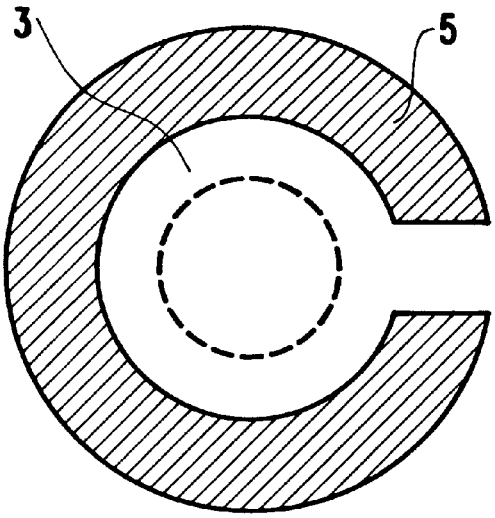
FIG. 3*c* is an upper plan view of the n-type semiconductor region and p-type semiconductor region shown in FIG. 3*a*.

As shown in FIGS. 3*a*–3*c*, the present invention includes first n-type semiconductor region 1 formed as a unit with the substrate; emitter electrode 9 formed on the bottom of n-type semiconductor region 1; second n-type semiconductor region 2 formed on n-type semiconductor region 1 and having a neutral region inside; first p-type semiconductor region 4 formed so as to surround n-type semiconductor region 2 on n-type semiconductor region 1; third n-type semiconductor region 3 formed on n-type semiconductor region 2 and p-type semiconductor region 4 and having a neutral region inside; second p-type semiconductor region 5 formed so as to surround n-type semiconductor region 3 on p-type semiconductor region 4; n-type semiconductor region 10 formed on top of n-type semiconductor region 3 and having an n-type impurity concentration equal to or greater than the concentration of n-type semiconductor region 3; emitters 6 formed on $n^+$-type semiconductor region 10 and having acute tips; insulation film 8 formed so as to surround emitters 6; and gate electrode 7 formed on insulation film 8; wherein n-type semiconductor region 2 is formed such that a cross section parallel to the substrate is smaller than the cross section of n-type semiconductor region 3. In other words, the n-type region that is composed of n-type semiconductor regions 1–3 is of a shape having a constricted midsection at n-type semiconductor region 2.

In addition, as shown in FIG. 3*c*, in this embodiment, one portion of p-type semiconductor region 5 is absent, but the depletion layer is formed completely around the circumference of the n-type region, and the neutral region is electrically isolated.

Explanation is next presented regarding the operation of the field emission cold cathode element configured as described hereinabove.

When electrons are supplied from emitter electrode 9, the supplied electrons pass through n-type semiconductor region 1 and the neutral region of n-type semiconductor region 2 and flow to the neutral region of n-type semiconductor region 3.

Due to the cross section of n-type semiconductor region 3, which is greater than the cross section of n-type semiconductor region 2, electrons that have flowed into n-type semiconductor region 3 spread out as they flow toward emitters 6 and are emitted from the emission tips.

Here, during normal operation, a large voltage is not impressed between the emitters and the cathode and the spread of the depletion layer is not great, and as a result, the device operates as a low-current region and no limits are imposed on current. If the potential of the emitters should increase due to discharge, however, a depletion layer spreads from n-type semiconductor region 1, and n-type semiconductor region 3 is depleted, thereby acting as pinch resistance. Since current flowing at this time becomes the saturation current of a transistor, discharge breakdown of the element can be prevented by setting to the element breakdown current or lower.

Moreover, a depletion layer spreads from inside n-type semiconductor region 2, which is surrounded by p-type semiconductor region 41 and a pinch-off state is entered that begins saturation of the emitter current.

Accordingly, the value of this saturation current can be prescribed by setting the size (cross section) and concentration of p-type semiconductor region 4 to appropriate values.

Ordinarily, and particularly during high-speed operation or operation at low power consumption, resistance from the emitter electrode to the emitters is preferably low during normal operation, in which discharges do not occur; but in the case of a design in which the cross section of an n-type semiconductor region made up of two or more regions is cut off with a pinch-off characteristic as in this embodiment, a lower resistance below the emitters can be sought.

Explanation is next presented regarding an embodiment of the present invention with reference to the accompanying figures.

Figure 4A:
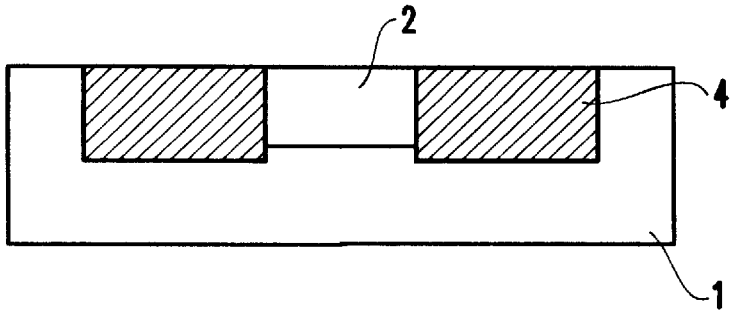
FIGS. 4*a*–4*d* shows the manufacturing processes of the field emission cold cathode element shown in FIGS. 3*a*–3*c*.

First, using ion implantation by boron atoms with, for example, an oxide film as a mask and thermal diffusion, ring-shaped p-type semiconductor region 4, which serves as a p-type diffusion layer, is formed to a depth of approximately 2 $\mu$m, and n-type semiconductor region 2 having a concentration of $1\times10^{15}$ $cm^{-3}$ is formed inside the ring of p-type semiconductor region 4 on the surface of n-type semiconductor region 1, which is a substrate having a concentration of $1\times10^{15}$ $cm^{-3}$ (FIG. 4*a*). Here, phosphorus atoms may be added by ion implantation and thermal diffusion to n-type semiconductor region 2 inside the ring to control the concentration.

Next, following the formation of n-type semiconductor region 3, which is to be an n-type silicon epitaxial layer having a concentration of $1\times10^{15}$ $cm^{-3}$, ring-shaped p-type semiconductor region 5, which is to be a p-type diffusion layer having a concentration of approximately $1\times10^{19}$ $cm^{-3}$, is formed by means of ion implantation of boron atoms using, for example, an oxide film as a mask, and thermal diffusion. In addition, n-type semiconductor region 3 having a concentration of $1\times10^{15}$ $cm^{-3}$ is formed inside the ring of p-type semiconductor region 5.

Figure 4B:
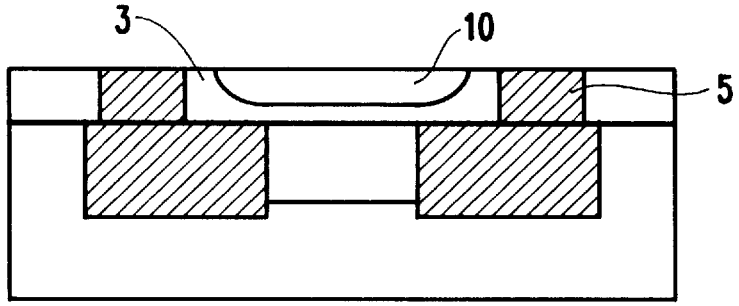

Phosphorus having a concentration of $1\times10^{20}$ $cm^{-3}$ is implanted, n-type semiconductor region 3 is activated by a heat process, and $n^+$-type semiconductor region 10 having an n-type impurity concentration equal to or greater than the concentration of n-type semiconductor region 3 is formed (FIG. 4*b*).

Figure 4C:
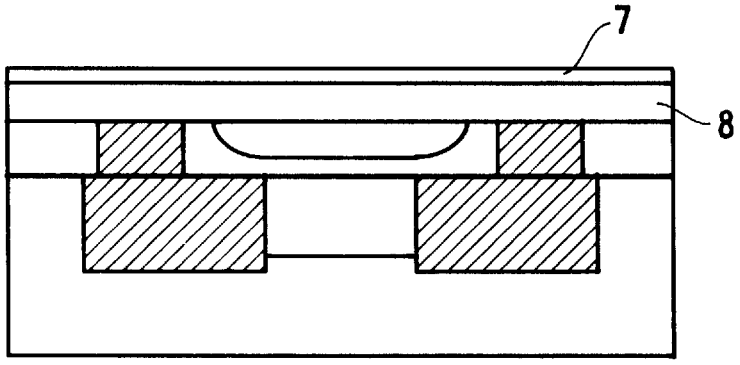

Insulation layer 8 is next formed by depositing a silicon dioxide film, and gate electrode 7 is formed from, for example, tungsten on insulation layer 8 (FIG. 4*c*).

Figure 4D:
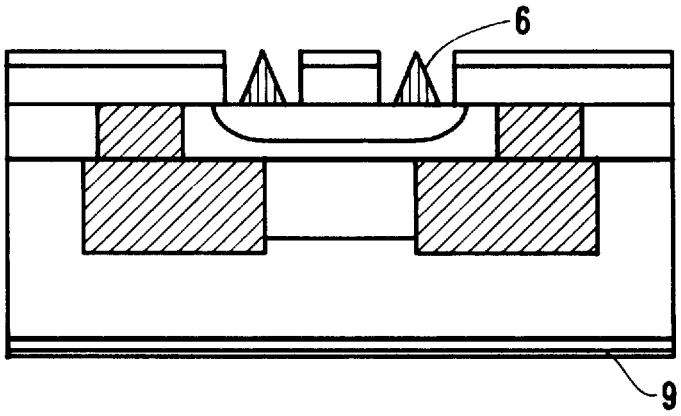

Next, holes for emitters are opened in insulation layer 8 and gate electrode 7, a sacrificial layer of, for example, aluminum is formed by a diagonal evaporation method and molybdenum is formed by vertical evaporation, and the sacrificial layer and surplus molybdenum are then lifted off and removed by etching, thereby forming emitters 6 (FIG. 4*d*).

Figure 5:
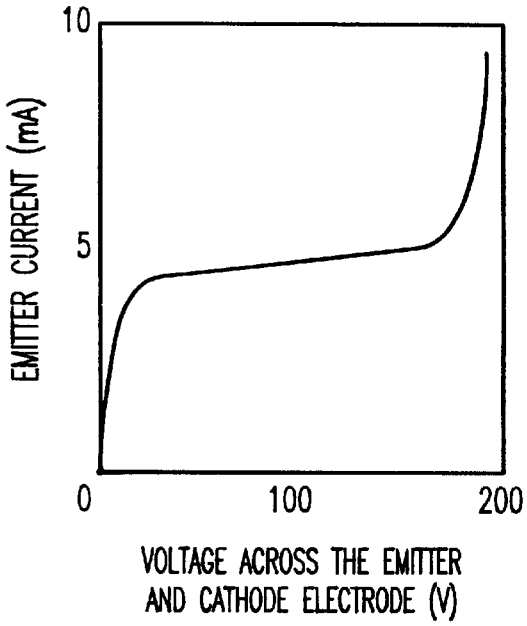
FIG. 5 shows the characteristic of the emitter current with respect to voltage across the emitter and cathode electrode in the event of a short circuit due to, for example, aluminum between the gate and emitter of the field emission cold cathode element shown in FIGS. 3*a*–3*c*.

FIG. 5 shows the emitter current characteristic with respect to voltage across the emitter and cathode electrode during short-circuits caused by, for example, aluminum between the gate and an emitter of a field emission cold cathode element shown in FIGS. 3*a*–3*c*. FIG. 5 shows the current-voltage characteristic for a case in which the concentrations of n-type semiconductor regions 1–3 are set to $1\times10^{15}cm^{-3}$, the size (cross section) of n-type semiconductor region 2 is approximately 200 $\mu m^2$, the concentration of p-type semiconductor region 4 is $1\times10^{16}cm^{-3}$, and the depth of p-type semiconductor region 4 is 6 $\mu$m.

As shown in FIG. 5, the emitter current is saturated and enters a pinch-off state when the emitter/cathode electrode voltage reaches 20 V. Moreover, the saturation current is approximately 5 mA and can be suppressed to lower than the minimum current level of 10 mA that is found in experiments at element breakdown. In addition, the breakdown voltage is in the vicinity of 150 V and can be made greater than the maximum gate-emitter voltage of 100 V necessary for obtaining emission.

As described hereinabove, the saturation current and breakdown voltage are determined by the concentrations of n-type semiconductor regions 1–3, the size (cross section) of n-type semiconductor region 2, and the concentration and depth of p-type semiconductor region 4, and are within a range that allows optimum design within the operating range completely independent of the size (emitter size or number of elements) of n-type semiconductor region 3.

The value of the saturation current is in inverse proportion to the length of n-type semiconductor region 2 in the longitudinal direction, and the saturation current can be made small when n-type semiconductor region 2 is long, but when short, the saturation current may become too great, eliminating the effect with respect to element breakdown. This length in the longitudinal direction is appropriate to the depth of p-type semiconductor region 4, and together with the impurity concentration bears a relation with the breakdown voltage. The greater the depth, the more field intensity is eased and the higher the breakdown voltage.

On the other hand, the value of the resistance is proportional to the depth of the diffusion layer, and as a result, the rise voltage value in FIG. 5 increases. A low resistance is crucial for high-speed operation, and as a result, a construction that optimizes these values is essential.

Figure 6A:
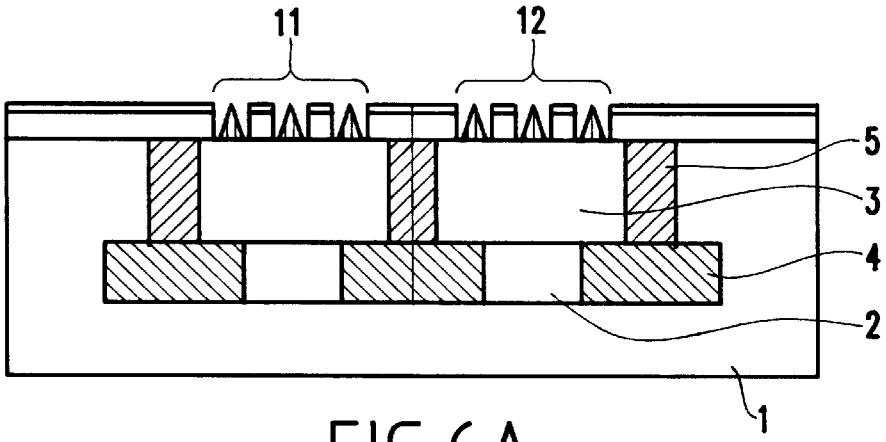
FIG. 6*a* is a sectional view showing a case in which the emitter region of the field emission cold cathode element shown in FIGS. 3*a*–3*c* is divided into two emitter groups.
Figure 6B:
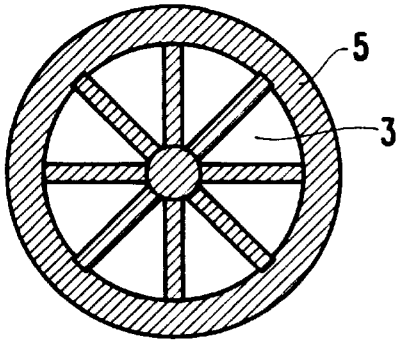
FIG. 6*b* is an upper surface plan of the n-type semiconductor region and p-type semiconductor region for a case in which the emitter groups shown in FIG. 6*a* are each divided into eight units.
Figure 6C:
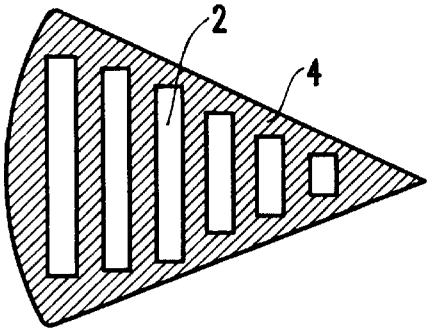
FIG. 6*c* is an upper surface plan of the n-type semiconductor region and p-type semiconductor region for a case in which the emitter groups shown in FIG. 6*a* are each divided into six units.

FIGS. 6*a*–6*c* shows an embodiment in which the emitter region of the field emission cold cathode element shown in FIGS. 3*a*–3*c* is divided.

As shown in FIG. 6*a*, the emitter region in this embodiment is divided into two emitter groups 11 and 12, whereby the current of one emitter group can be suppressed to a low level even at a total emission amount that exceeds the minimum element breakdown current of 10 mA.

The width of n-type semiconductor region 2 must be reduced to suppress saturation current to a low level, but this results in an increase in the rise resistance of FIG. 5 because the area of n-type semiconductor region 2 is also reduced in such a case. To solve this problem, the width of n-type semiconductor region 2 is set to produce an appropriate saturation current value and a plurality of n-type semiconductor regions having this width are provided within a single emitter group as shown in FIG. 6*c*, thereby effectively increasing the cross section.

Since p-type impurity is diffused equally in the direction of the depth and the direction of width when forming p-type semiconductor region 4 by thermal diffusion, this diffusion must be taken into consideration when determining the width of the mask material used in photolithography techniques. The emitter groups in FIG. 6*b* are in a fan shape, but the shape may be freely determined as, for example, a checkerboard pattern or comb pattern. Similarly, the shape of n-type semiconductor region 2 in FIG. 6*c* may also be freely determined as, for example, a grid or a circle.

Figure 7C:
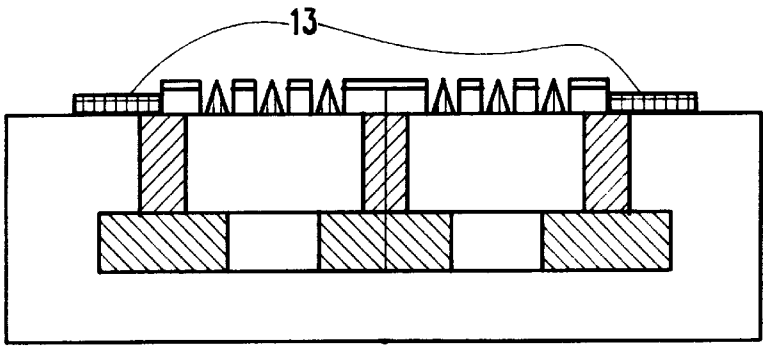
FIG. 7*c* shows a case in which the emitter region in the field emission cold cathode element shown in FIGS. 3*a*–3*c* is divided into two emitter groups and the n-type semiconductor region and the p-type semiconductor region are short-circuited only at the periphery of these emitter groups.
Figure 7A:
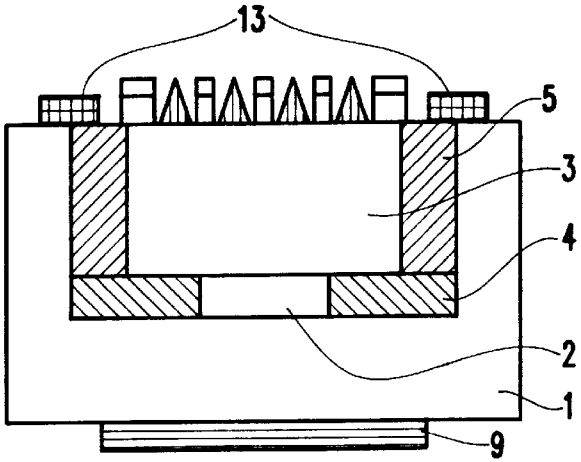
FIG. 7*a* shows a case in which the n-type semiconductor region and p-type semiconductor region in the field emission cold cathode element shown in FIGS. 3*a*–3*c* are electrically short-circuited by an electrode.
Figure 7B:
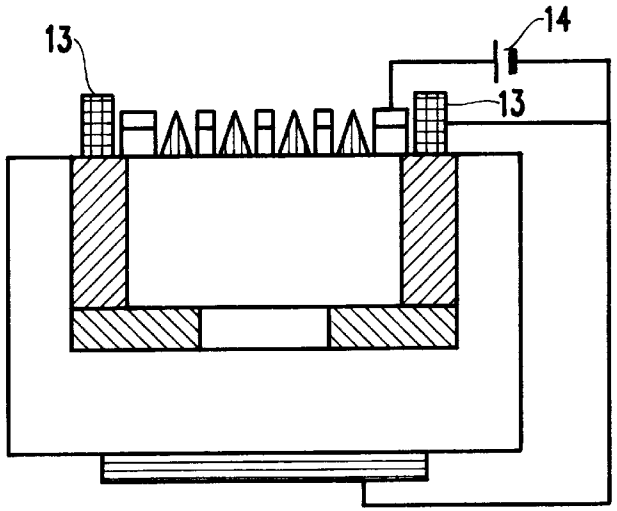
FIG. 7*b* shows a case in which the emitter electrode and p-type semiconductor region in the field emission cold cathode element shown in FIGS. 3*a*–3*c* are short-circuited.

FIGS. 7*a*–7*c* show an embodiment in which the n-type semiconductor region in the field emission cold cathode element shown in FIGS. 3*a*–3*c* is made to electrically short-circuit the p-type semiconductor region.

In the element shown in FIG. 7*a*, n-type semiconductor region 1 and p-type semiconductor region 5 are placed in electrical contact at the outer circumference of the emitters by means of electrodes 13, whereby the p-type semiconductor region can be fixed to the substrate potential without the need for providing new electrodes.

In the element shown in FIG. 7*b*, electrodes 13 are provided on p-type semiconductor region 5 and electrode 13 and emitter electrode 9 are in a short circuit, whereby the p-type semiconductor region is fixed to the substrate potential. Moreover, the gate voltage is impressed to the gate from power source 14. Although the substrate potential and the potential of the p-type semiconductor region are the same in this embodiment, a new power source may be provided and the p-type semiconductor region fixed to a different potential.

In the element shown in FIG. 7*c*, the emitter region is divided and only the outermost p-type semiconductor region is short-circuited. The p-type semiconductor regions are in an electrically conductive state in this case, and the potential may be fixed by providing electrodes at only one portion.

Although the sizes of the cross sections of the n-type semiconductor regions are adjusted to realize pinch-off in the above-described embodiments, the concentration of the n-type semiconductor regions or the concentrations of the p-type semiconductor regions may also be freely regulated to control the size of the neutral region, or control may be achieved by regulating both the sizes and concentrations.

In addition, the n-type semiconductor regions are enclosed by p-type semiconductor regions in the above-described embodiments, but even if a portion of the p-type semiconductor regions is an n-type semiconductor region, a depletion layer in effect spreads from p-type semiconductor region, and as a result, the n-type semiconductor region can be electrically confined.

While preferred embodiments of the present invention have been described using specific terms, such description is for illustrative purposes only, and it is to be understood that changes and variations may be made without departing from the spirit or scope of the following claims.

What is claimed is:

1. A field emission cold cathode element comprising:

a first n-type semiconductor region formed as a unit with the substrate;

a second n-type semiconductor region that is formed above said first n-type semiconductor region, that is electrically connected on its bottom surface to said first n-type semiconductor region;

a third n-type semiconductor region that is formed on said second n-type semiconductor region, that is electrically connected on its bottom surface to said second n-type semiconductor region;

and at least one emitter provided with a sharp tip that emits electrons arranged on said third n-type semiconductor region;

wherein said second n-type semiconductor region has a smaller cross section than the cross section of said third n-type semiconductor region when said second n-type semiconductor region and said third n-type semiconductor region are cut along planes parallel to said substrate.

2. A field emission cold cathode element according to claim 1 further including a first p-type semiconductor region that contacts at least one portion of the circumference of the side surface of said second n-type type semiconductor region.

3. A field emission cold cathode element according to claim 1 further including a p-type semiconductor region that contacts at least one portion of the circumference of the side surface of said third n-type semiconductor region.

4. A field emission cold cathode element according to claim 2 further including a second p-type semiconductor region that contacts at least one portion of the side surface of said third n-type semiconductor region.

5. A field emission cold cathode element according to claim 3 wherein said p-type semiconductor region electrically short circuits with said first n-type semiconductor region.

6. A field emission cold cathode element according to claim 4 wherein said second p-type semiconductor region electrically short-circuits with said first n-type semiconductor region.

7. A field emission cold cathode element according to claim 1 wherein the n-type impurity concentration of said third n-type semiconductor region in the vicinity of said emitter is equal to or greater than the n-type impurity concentration of said third n-type semiconductor region in the vicinity of said second n-type semiconductor region.

8. A field emission cold cathode element according to claim 2 wherein the n-type impurity concentration of said third n-type semiconductor region in the vicinity of said emitter is equal to or greater than the n-type impurity concentration of said third n-type semiconductor region in the vicinity of said second n-type semiconductor region.

9. A field emission cold cathode element according to claim 3 wherein the n-type impurity concentration of said third n-type semiconductor region in the vicinity of said emitter is equal to or greater than the n-type impurity concentration of said third n-type semiconductor region in the vicinity of said second n-type semiconductor region.

10. A field emission cold cathode element according to claim 4 wherein the n-type impurity concentration of said third n-type semiconductor region in the vicinity of said emitter is equal to or greater than the n-type impurity concentration of said third n-type semiconductor region in the vicinity of said second n-type semiconductor region.

11. A field emission cold cathode element according to claim 5 wherein the n-type impurity concentration of said third n-type semiconductor region in the vicinity of said emitter is equal to or greater than the n-type impurity concentration of said third n-type semiconductor region in the vicinity of said second n-type semiconductor region.

12. A field emission cold cathode element according to claim 6 wherein the n-type impurity concentration of said third n-type semiconductor region in the vicinity of said emitter is equal to or greater than the n-type impurity concentration of said third n-type semiconductor region in the vicinity of said second n-type semiconductor region.

* * * * *